US005960525A

United States Patent [19]

Fleissner

[11] Patent Number: 5,960,525

[45] Date of Patent: Oct. 5, 1999

[54] DEVICE FOR HYDRODYNAMIC ENTANGLEMENT OF THE FIBERS OF A FIBER WEB

[75] Inventor: Gerold Fleissner, Zug, Switzerland

[73] Assignee: Fleissner GmbH & Co.Maschinenfabrik, Egelsbach, Germany

[21] Appl. No.: 09/022,629

[22] Filed: Feb. 12, 1998

[30] Foreign Application Priority Data

Feb. 12, 1997 [DE] Germany ..... 197 05 292
Feb. 20, 1997 [DE] Germany ..... 197 06 610

[51] Int. Cl.[6] ..... D04H 1/46

[52] U.S. Cl. ..... 28/104; 28/105

[58] Field of Search ..... 28/104, 105, 103, 28/116, 122, 134, 135, 136, 138, 167; 26/18.6; 68/204, 205 R

[56] References Cited

U.S. PATENT DOCUMENTS

| | | | |
|---|---|---|---|
| 3,676,245 | 7/1972 | Helmut et al. | 28/105 |
| 3,866,277 | 2/1975 | Hojyo | 26/18.6 |
| 4,005,566 | 2/1977 | Hawkins | 28/104 |
| 4,112,559 | 9/1978 | Troope et al. | 26/18.6 |
| 5,261,146 | 11/1993 | Belliot | 26/18.6 |
| 5,290,628 | 3/1994 | Lim et al. | 28/104 |
| 5,573,841 | 11/1996 | Adam et al. | 28/104 |
| 5,704,102 | 1/1998 | Catallo | 26/18.6 |
| 5,718,022 | 2/1998 | Vuillaume | 28/104 |
| 5,761,778 | 6/1998 | Fleissner | 28/104 |

FOREIGN PATENT DOCUMENTS

| | | | |
|---|---|---|---|
| 731854 | 4/1966 | Canada | 28/105 |

*Primary Examiner*—Amy Vanatta
*Attorney, Agent, or Firm*—Antonelli, Terry, Stout & Kraus, LLP

[57] ABSTRACT

A device for hydrodynamic entanglement operates to compact the fibers of a fiber web made of natural and/or manmade fibers. The device includes a first endless belt supporting the fiber web, the first endless belt being guided under tension and stretched between at least two rolls, including a reversing roll, and a second endless belt likewise stretched between at least two rolls, the second endless belt being located opposite the first endless belt and traveling in the same direction as the first endless belt, a tight side of the second endless belt being located opposite a tight side of the first endless belt. The second endless belt is driven to turn in the same direction as the first endless belt. The tight sides of the first and second endless belts are directed conically toward one another along their lengths, so that the fiber web lying on the tight side of the first endless belt is increasingly compressed between the advancing first and second endless belts. A pair of rolls is provided for pressing the second endless belt against the reversing roll of the first endless belt for greater wrapping of the reversing roll by the first and second endless belts. An associated needling drum is provided with which at least one nozzle beam is associated across the working width and axially parallel thereto. An additional nozzle beam is provided between the pair of rolls for wetting the fiber web, water jets of the additional nozzle beam being directed against the back of and through the second endless belt and against the fiber web which is compressed and held between the first and second endless belts.

8 Claims, 3 Drawing Sheets

DEVICE FOR HYDRODYNAMIC ENTANGLEMENT OF THE FIBERS OF A FIBER WEB

BACKGROUND OF THE INVENTION

The invention relates to a device for hydrodynamic entanglement for preferably binder-free compaction of the fibers of a fiber web composed of natural and/or manmade fibers of any kind, consisting of a) a first endless belt supporting the fiber web, said belt being guided under tension and reversed between a minimum of two rolls, and b) an associated needling drum with at least one nozzle beam associated therewith, mounted axially parallel thereto and extending over the working width, and c) at least one additional nozzle beam whose water jets are directed against the back of an endless belt and through said belt against the fiber web, at least for wetting the web.

A device of this kind is known from WO 96/23921. It has the advantage that the voluminous fleece arriving on an endless belt for water needling is compressed between the needling drum and the belt and at the same time is wetted by a first water curtain from the nozzle beam, whose water jets initially pass through the endless belt and then through the fiber web and finally the needling drum. However, the fact that the fiber web does not remain compressed on contact with the needling drum is disadvantageous because the circular circumferential surface of the needling drum that comes in contact with one side of the fiber web is larger than the corresponding projected length of the endless belt on the other side of the fiber web. As a result, when the fiber web is compressed against the drum, a shear stress develops between the two surfaces of the fiber web, which has a negative effect on the composition of the fleece, especially in the case of thicker fleeces.

Another device of this kind is disclosed in previous patent application 196 27 256.4. In that document d) a second endless belt, likewise stretched between at least two rolls, is located opposite the first endless belt, with the tight side of said second belt being located opposite the tight side of the first endless belt and, driven in the same direction, traveling in the same direction as the first endless belt;

e) the two tight sides of the endless belts are directed conically toward one another along their lengths, so that the fiber web resting on the tight side of the first endless belt is increasingly compressed between the advancing endless belts.

In this case also, a nozzle beam is directed against the endless belt to wet the fiber web, with the fiber web compressed between the two endless belts being initially wetted before being needled on the transfer drum.

The device according to the older patent application has the advantage that the voluminous fiber web advancing between the two endless belts is slowly compressed to an increasing degree under uniform pressure from above and below without any shear stress, and is not wetted until it is firmly gripped between the two endless belts.

SUMMARY OF THE INVENTION

Taking its departure from the device according to the WO-OS, the goal of the invention is to provide a first needling unit that not only retains the advantages of the device according to the older patent application but also permits a greater compression of the fleece prior to the initial wetting of the fiber web. A greater compression, or more correctly, an improved grip on the fibers of the fiber web during wetting would for example prevent individual fibers from detaching and would eventually produce a better fleece product.

To achieve this goal, the invention provides that d) a second endless belt, likewise stretched between at least two rolls, is located opposite the first endless belt, whose tight side opposite the tight side of the first endless belt is driven to rotate in the same direction as the first endless belt, e) the two tight sides of the two endless belts are directed conically toward one another along their lengths, so that the fiber web lying on the tight side of the first endless belt is increasingly compressed between the advancing endless belts, f) the second endless belt is pressed by two rolls against a return roll of the first endless belt for greater wrapping of the reversing roll by the two endless belts, and g) the nozzle beam for wetting the fiber web is directed between these two rolls against the fiber web held compressed between the two endless belts.

Therefore, with this device the abovementioned advantageous features of the device according to the older patent application are improved and supplemented by virtue of the fact that the fiber web, held compressed between the two endless belts is pressed firmly against the reversing roll of one of the two endless belts as it is wetted. This means that in a variety of embodiments, a roll of the first or second endless belt can be the reversing roll.

The two rolls that press the reversing roll against the two endless belts and between which the wetting beam is located, should be located close together and associated directly with the reversing roll. In this manner, the pressure at which the endless belts are pressed against the reversing roll will be at its maximum.

A variety of embodiments is possible while retaining this principle. Thus, the reversing roll can simultaneously be the needling drum, or one of the two pressure rolls can be a transfer drum which itself can then be designed as a needling drum. The details are included in the description of the figures.

BRIEF DESCRIPTION OF THE DRAWINGS

A device of the type according to the invention is shown as an example in the drawings.

DETAILED DESCRIPTION OF THE PREFERRED EMBODIMENTS

Figure 1:
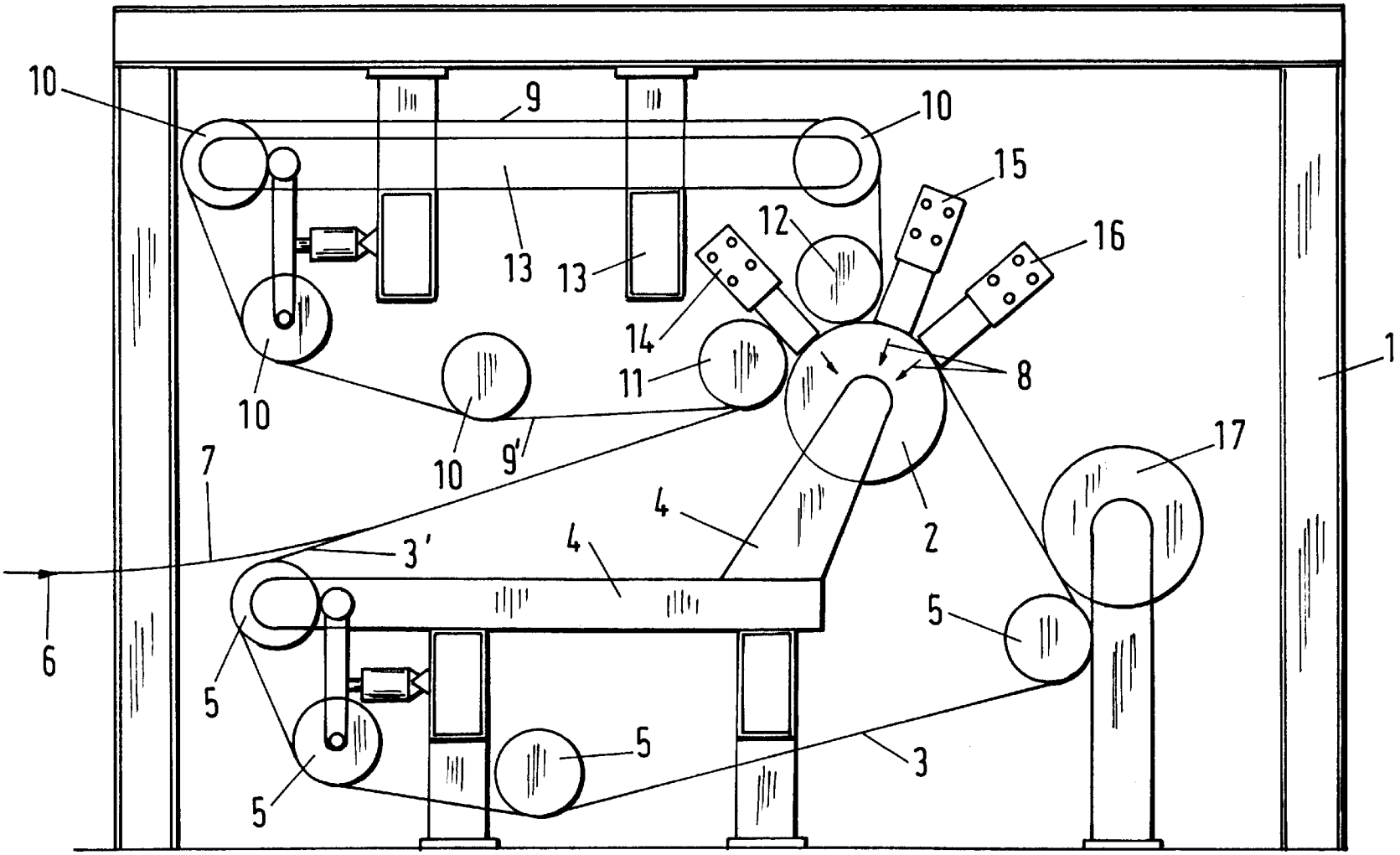
FIG. 1 shows, in a side view of a large system, a first needling device in which a reversing roll of the first endless belt is designed as a wetting drum and simultaneously serves as the needling drum.

A water needling unit with only one needling drum 2 is shown in a frame 1. This unit is normally the first unit in a large water-needling system in which a plurality of additional needling drums can therefore follow, said drums being wrapped meanderwise, thus allowing the fiber web to be processed from both sides.

Basically this unit consists of a first endless belt 3 that is wrapped and stretched over several rolls 2, 5 rotatably mounted in a frame 4. An initially more voluminous fiber web 7 to be needled advances in the direction of arrow 6 onto this endless belt. It can also be a fiber web that initially has no strength and thus is laid down by a card, not shown, directly onto endless belt 3. Roll 2 in this embodiment serves as the needling drum. This means that it is larger in diameter and is in the form of a permeable drum that is subjected to a vacuum (arrows 8) at least at the point where the water strikes.

A second endless belt 9 is located opposite first endless belt 3 in such fashion that tight side 3' of first endless belt 3 is opposite tight side 9' of the second endless belt, and tight sides 3' and 9' travel in the same direction and approach one another conically in this area. This is effected in turn by a plurality of rolls 10–12 of endless belt 9, said rolls being rotatably mounted on holder 13 fastened to frame 1.

Two of the rolls of second endless belt 9, namely rolls 11 and 12, are associated directly with reversing roll 2 of first endless belt 3 designed as a needling drum. This means that rolls 11 and 12 press tensioned endless belt 9 against endless belt 3 and then against reversing roll 2. For this purpose, they are located close together and only leave sufficient space between them to allow nozzle beam 14 to be advanced up to endless belt 9. Thus, the fiber web that is supplied and advanced by run 3' of endless belt 3 is not only slowly compressed between endless belts 3 and 9 but pressed against reversing roll 2. In this state, fiber web 7 is wetted by water beam 14 and can then be needled further.

In the embodiment according to FIG. 1, this is accomplished directly on this reversing roll 2, with endless belt 9 being carried away upward by means of roll 12, so that the upper side of fiber web 7 is freed from endless belt 9. Reversing roll 2 then has associated with it, in the run-off of the drum, two needling nozzle beams 15, 16 located axially parallel, said beams providing an initial interweaving of the fibers. Supported by endless belt 3, the fiber web is then transported further and fed to additional processing element 17, and thus separated from endless belt 3.

Figure 2:
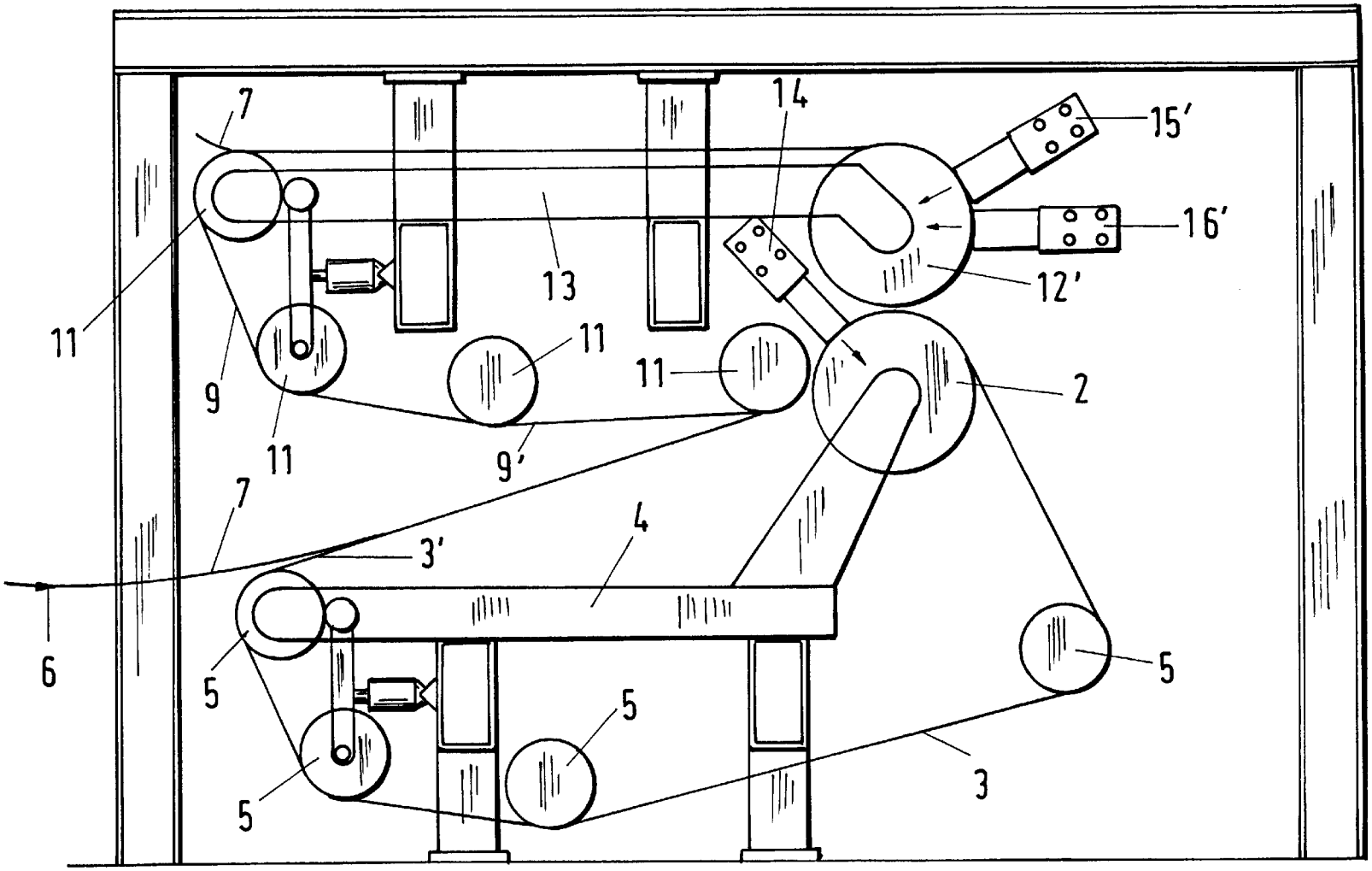
FIG. 2 shows the system according to FIG. 1 in which the reversing roll of the first endless belt is used only for wetting the fiber web, while needling is performed on a reversing roll for the second endless belt that follows and is designed as a transfer roll.

The same principle is retained when in the embodiment according to FIG. 2, roll 12 of second endless belt 9 is designed as a transfer roll 12' and simultaneously as a needling drum. Accordingly, nozzle beams 15' and 16' are located here, associated with the larger, perforated transfer roll 12' of endless belt 9. In this embodiment, wetting is performed by means of beam 14 and the first needling is performed by nozzle beams 15', 16' on different surfaces of the fiber web.

Figure 3:
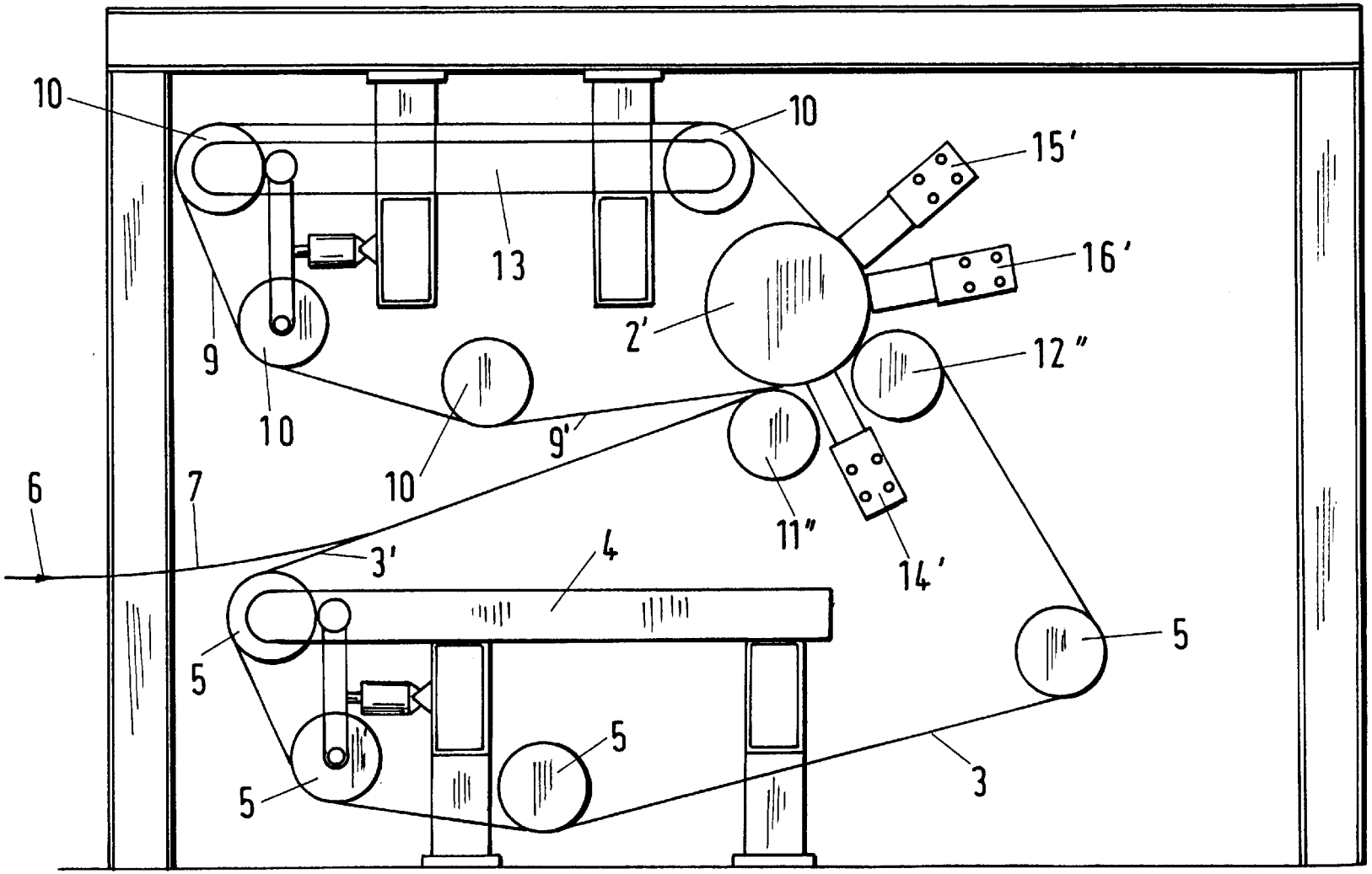
FIG. 3 shows the system according to FIG. 1 but with both wetting and needling being performed on the transfer roll of the second endless belt.

It is also possible to have yet another example according to FIG. 3 in which first endless belt 3 that supports fiber web 7 by two rolls 11' and 12' located close together but with a distance between them to receive beam 14', initially first endless belt 3, then fiber web 7, and then second endless belt 9 press against reversing roll 2' of second endless belt 9, with reversing roll 2' in this case, like reversing roll 12' in the embodiment according to FIG. 2, again being designed as a needling drum, for which reason nozzle beams 15' and 16' are associated with said drum. In this embodiment, wetting is performed by beam 14 and initial needling is performed by needle beam 15', 16' on the same surface of fiber web 7 as in the example in FIG. 1.

I claim:

1. A device for hydrodynamic entanglement for compaction of the fibers of a fiber web made of natural and/or manmade fibers, comprising:

a first endless belt supporting the fiber web, said first endless belt being guided under tension and stretched between at least two rolls, including a reversing roll;

an associated needling drum with which at least one nozzle beam is associated across the working width and axially parallel thereto;

a second endless belt likewise stretched between at least two rolls, said second endless belt being located opposite said first endless belt and traveling in the same direction as said first endless belt, a tight side of said second endless belt being located opposite a tight side of said first endless belt, said second endless belt being driven to turn in the same direction as said first endless belt;

wherein the tight sides of the first and second endless belts are directed conically toward one another along their lengths, so that the fiber web lying on the tight side of said first endless belt is increasingly compressed between the advancing first and second endless belts;

a pair of rolls for pressing said second endless belt against said reversing roll of said first endless belt for greater wrapping of said reversing roll by said first and second endless belts; and an additional nozzle beam provided between said pair of rolls for wetting the fiber web, water jets of the additional nozzle beam being directed against the back of and through the second endless belt and against the fiber web which is compressed and held between said first and second endless belts.

2. A device for hydrodynamic entanglement for compaction of the fibers of a fiber web made of natural and/or manmade fibers, comprising:

a first endless belt supporting the fiber web, said first endless belt being guided and reversed under tension between at least two rolls;

a needling drum, with which at least one nozzle beam is associated across the working width and axially parallel;

a second endless belt likewise guided between at least two rolls under tension, including a reversing roll, said second endless belt being located opposite said first endless belt, with a tight side of said second endless belt being located opposite a tight side of said first endless belt and rotating in the same direction as said first endless belt, wherein the tight sides of the first and second endless belts are directed conically toward one another along their lengths so that the fiber web resting on the tight side of said first endless belt is increasingly compressed between the advancing first and second endless belts;

a pair of rolls for pressing said first endless belt against said reversing roll of said second endless belt for greater wrapping of said reversing roll by said first and second endless belts; and an additional nozzle beam provided between said pair of rolls for wetting the fiber web, water jets of said additional nozzle beam being directed against the back of and through said first endless belt and against the fiber web which is compressed between said first and second endless belts.

3. Device according to claim 1 or 2, wherein said pair of rolls are provided close together and are spaced apart only a sufficient distance required for advancing said additional nozzle beam therebetween.

4. Device according to claim 1 or 2, wherein said reversing roll is a needling drum.

5. Device according to claim 4, wherein said reversing roll is a liquid-permeable screen drum having a diameter larger than those of said at least two rolls stretching each of said first and second endless belts.

6. Device according to claim 4, wherein said at least one nozzle beam is associated with a departing circumferential area of said reversing roll.

7. Device according to claim 2, wherein the reversing roll is a fiber web transfer roll for transferring the fiber web from said first endless belt to said second endless belt.

8. Device according to claim 7, wherein said fiber transfer roll is a liquid-permeable screen drum with a diameter larger than that of those of said at least two rolls stretching each of said first and second endless belts, and is associated with said at least one nozzle beam for water needling.

* * * * *